US005711117A

United States Patent [19]

Zaccagni et al.

[11] Patent Number: 5,711,117

[45] Date of Patent: *Jan. 27, 1998

[54] COMBINATION OF SOFFIT PANEL, SIDING PANEL, AND SOFFIT-PANEL MOUNTING AND SIDING PANEL-TRIMMING ASSEMBLY

[75] Inventors: Richard J. Zaccagni, Downers Grove; Gregory R. Zaccagni, Aurora, both of Ill.

[73] Assignee: ZMC, Inc., Addison, Ill.

[ * ] Notice: The term of this patent shall not extend beyond the expiration date of Pat. No. 5,657,585.

[21] Appl. No.: 704,423

[22] Filed: Aug. 20, 1996

Related U.S. Application Data

[63] Continuation-in-part of Ser. No. 568,627, Dec. 7, 1995.

[51] Int. Cl.[6] ..... E04B 7/00

[52] U.S. Cl. ..... 52/94; 52/518

[58] Field of Search ..... 52/60, 94, 95, 52/97, 518

[56] References Cited

U.S. PATENT DOCUMENTS

| | | | |
|---|---|---|---|
| 3,344,566 | 10/1967 | Miles et al. . | |
| 4,109,428 | 8/1978 | Aarons . | |
| 4,227,352 | 10/1980 | Hallam . | |
| 4,339,898 | 7/1982 | Pichette . | |
| 4,461,128 | 7/1984 | Knoebl | 52/94 |
| 4,648,218 | 3/1987 | Butzen | 52/60 X |
| 4,819,390 | 4/1989 | Caper et al. . | |
| 5,123,208 | 6/1992 | Kirby et al. . | |
| 5,195,283 | 3/1993 | MacLeod et al. . | |
| 5,377,463 | 1/1995 | Howe . | |

FOREIGN PATENT DOCUMENTS

| | | | |
|---|---|---|---|
| 1609913 | 4/1970 | Germany | 52/60 |

OTHER PUBLICATIONS

Armor Bond Building Products, Inc., Dynaforged Product Directory, front cover, pp. 1–6, and back cover, 1994—See "F Channel" on p. 2 and Undersill Trim on p. 4.

Omni Products, Omni Facade Installation Instructions, six pages, undated–admitted prior art.

Omni Fascia Installation Instructions, two pages undated–admitted prior art.

*Primary Examiner*—Wynn E. Wood
*Assistant Examiner*—Timothy B. Kang
*Attorney, Agent, or Firm*—Dressler, Rockey, Milnamow & Katz, Ltd.

[57] ABSTRACT

A generally vertical siding panel having an upper edge portion formed with at least two laterally spaced trim-engaging tabs and a generally horizontal soffit panel having a back edge portion are employed with a siding panel-trimming and soffit-panel mounting assembly comprising a supporting member and a retaining member. As extruded from a polymeric material, the supporting member has a generally vertical back panel and an upper front flange, which projects frontwardly from the back panel and overlies the back edge portion of the soffit panel. As extruded from a polymeric material, the retaining member is a separate member attached to the supporting member and has a lower front flange, which projects from the back panel and underlies the back edge portion of the soffit panel. One of the supporting and retaining members defines a hook behind the back panel. The hook interengages with the trim-engaging tabs, for trimming and mounting the upper edge portion of the siding panel so as to conceal the upper edge portion of the siding panel and the trim-engaging tabs behind the back panel. The back panel is offset so as to have an upper portion and a lower portion with the upper portion behind and above the lower portion. In a preferred embodiment, in which the supporting member defines the hook, the lower portion of the back panel defines a socket, which opens downwardly and receives a back edge portion of the retaining member. The socket and the back edge portion of the retaining member are shaped complementarily so as to enable the back edge portion thereof to be snap-fitted into the socket. In an alternative embodiment, in which the retaining member defines the hook, the lower portion of the back panel defines a channel, which opens upwardly and receives a back edge portion of the retaining member.

10 Claims, 3 Drawing Sheets

FIG. 4
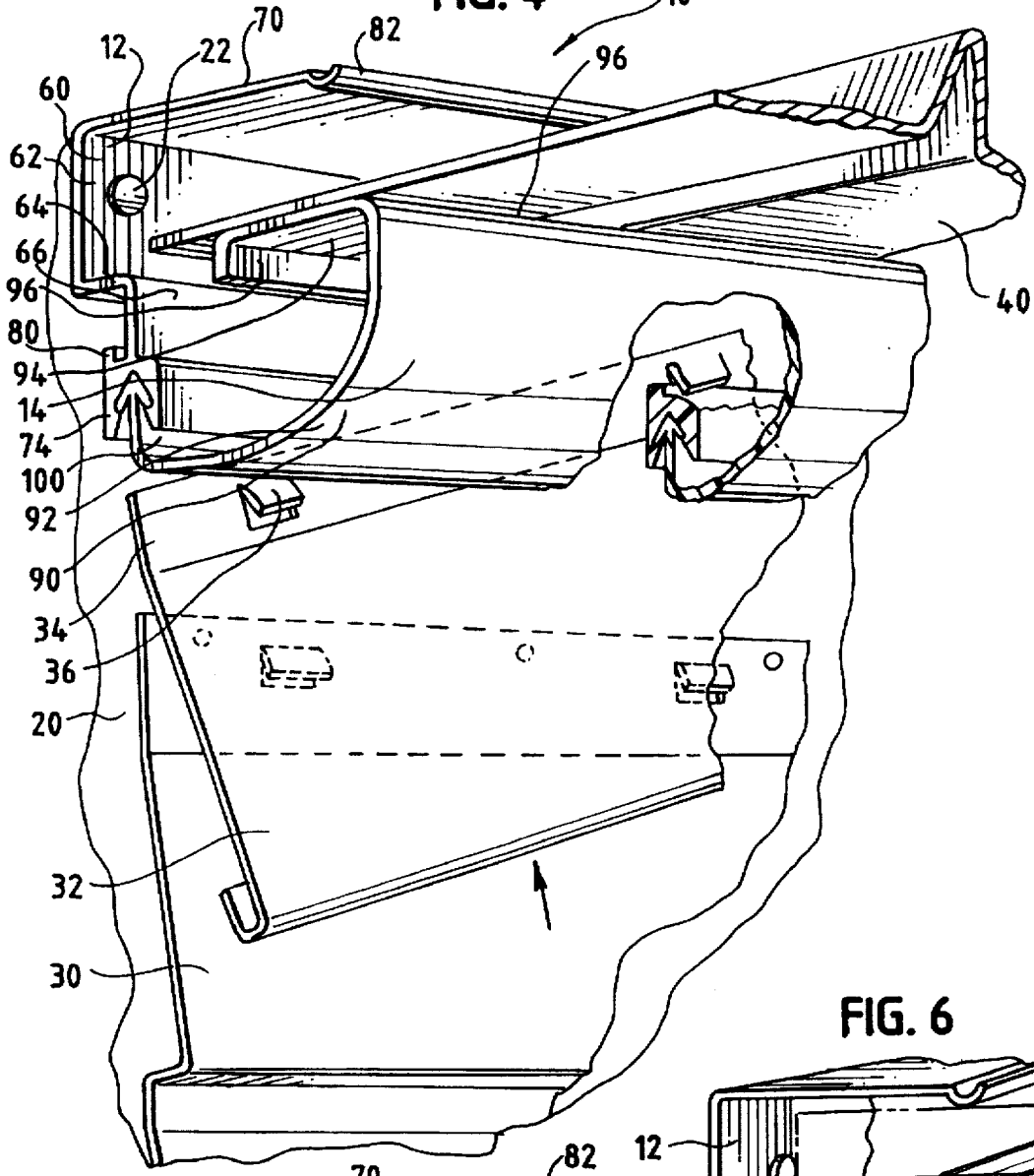
FIG. 6
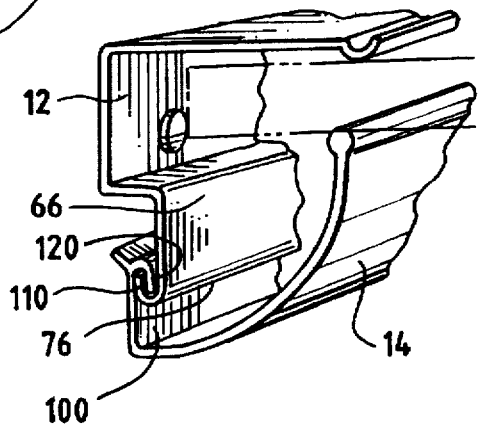
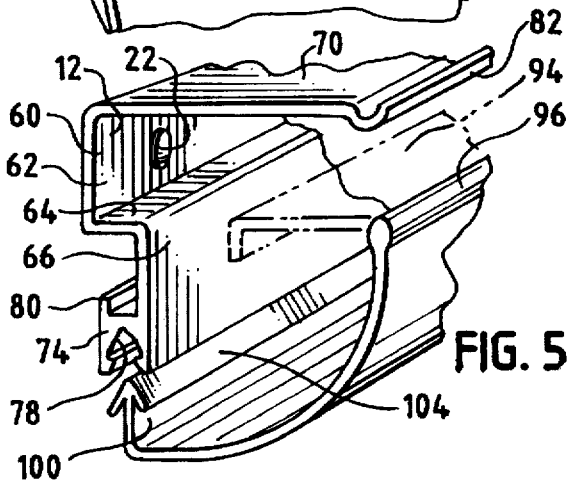
FIG. 5

COMBINATION OF SOFFIT PANEL, SIDING PANEL, AND SOFFIT-PANEL MOUNTING AND SIDING PANEL-TRIMMING ASSEMBLY

CROSS-REFERENCE TO RELATED APPLICATION

This application is a continuation-in-part of U.S. patent application Ser. No. 08/568,627, which was filed on Dec. 7, 1995, and the disclosure of which is incorporated herein by reference.

TECHNICAL FIELD OF THE INVENTION

The present invention pertains to a novel combination comprising a generally vertical siding panel, a generally horizontal soffit panel, and a siding panel-trimming and soffit-panel mounting assembly, which comprises a supporting member and a retaining member. The assembly is an improvement over the siding panel-trimming and soffit panel-mounting member disclosed in U.S. patent application Ser. No. 08/568,627, supra.

BACKGROUND OF THE INVENTION

As exemplified in Miles et al. U.S. Pat. No. 3,344,566, it is known to mount a back edge portion of a soffit panel by means of a two-piece assembly, which is comprised of a so-called mould bar receiver and a so-called mould bar, and which also is used to secure an upper edge portion of a frieze plate. A portion of the mold bar receiver overlies the back edge portion of the soffit panel and a portion of the mould bar underlies the back edge portion of the soffit panel. The mould bar receiver is formed with tabs, which support the back edge portion of the soffit panel until the mould bar is installed. The upper edge portion of the frieze plate is offset and projects upwardly into a downwardly opening groove formed by the mould bar receiver.

As exemplified in Howe U.S. Pat. No. 5,377,463, it is known to mount a back edge portion of a soffit panel by means of a one-piece, extruded, mounting section having two jaws, namely an upper jaw overlying the back edge portion of the soffit panel and a lower jaw underlying the back edge portion of the soffit panel. The lower jaw is flexible so as to enable the back edge portion of the soffit panel to be upwardly snapped past the lower jaw. Howe does not teach mounting, securing, or trimming an upper edge portion of a siding panel or of a frieze plate.

In U.S. patent application Ser. No. 08/568,627, supra, a combination siding panel-trimming and soffit-panel mounting member is disclosed, which is extruded in one piece, and which is useful with a generally horizontal soffit panel having a back edge portion and with a generally vertical siding panel having an upper edge portion formed with at least two laterally spaced trim-engaging tabs. The combination member has a generally vertical back panel, means including an upper front flange projecting frontwardly from the back panel and overlying the back edge portion of the soffit panel and a lower front flange projecting frontwardly from the back panel and underlying the back edge portion of the soffit panel for mounting the back edge portion of the soffit panel, and means including a back flange projecting from the back panel, the back flange defining a hook interengaging with the trim-engaging tabs on the upper edge portion of the siding panel, for trimming and mounting the upper edge portion of the siding panel so as to conceal the upper edge portion of the siding panel and said tabs behind the back panel. The lower front flange is flexible so as to enable the back edge portion of the soffit panel to be upwardly snapped past the lower front panel.

This invention has resulted from efforts to improve the combination siding panel-trimming and soffit-panel mounting member disclosed in U.S. patent application Ser. No. 08/568,627, supra.

SUMMARY OF THE INVENTION

This invention provides a novel combination comprising a generally horizontal soffit panel having a back edge portion, a generally vertical siding panel having an upper edge portion formed with at least two laterally spaced trim-engaging tabs, and a siding panel-trimming and soffit-panel mounting assembly comprising a supporting member and a retaining member.

The supporting member has a generally vertical back panel and an upper front flange projecting frontwardly from the back panel and overlying the back edge portion of the soffit panel. The retaining member is a separate member attached to the supporting member and has a lower front flange projecting from the back panel and underlying the back edge portion of the soffit panel. One of the supporting and retaining members defines a hook behind the back panel. The hook interengages with the trim-engaging tabs on the upper edge portion of the siding panel, for trimming and mounting the upper edge portion of the siding panel so as to conceal the upper edge portion of the siding panel and the trim-engaging tabs behind the back panel.

Preferably, the retaining member has a back flange, and the supporting member has means for receiving the back flange of the retaining member so as to attach the retaining member to the supporting member and so as to conceal the back flange of the retaining member behind the back wall. Preferably, the back panel is stepped so as to have an upper portion, a middle portion, and a lower portion including the receiving means. Thus, the upper portion being behind and above the lower portion, and the upper and lowe portions are generally vertical.

In a preferred embodiment, in which the supporting member defines the hook, the lower portion of the back panel defines a socket, which opens downwardly and receives an upper portion of the back flange of of the retaining member. The socket and the back flange are shaped complementarily so as to enable the flange to be snap-fitted into the socket.

In an alternative embodiment, in which the retaining member defines the elongate hook interengaging with the trim-engaging tabs, the lower portion of the back panel defines an upturned hook, and the back flange of the retaining member defines a downturned hook interengaging with the upturned hook.

Preferably, each of the supporting and retaining members is extruded in one piece. Preferably, each of the supporting and retaining members is extruded from from a polymeric material.

These and other objects, features, and advantages of this invention are evident from the following description of a preferred embodiment of this invention and two alternative embodiments, with reference to the accompanying drawings.

BRIEF DESCRIPTION OF THE DRAWINGS

FIG. 4 is a fragmentary, perspective view of the supporting and retaining members and two siding panels, which include an uppermost siding panel, after the retaining member has been mounted to the supporting member so as to mount the back edge portion of the soffit panel, which also is shown fragmentarily, and as the uppermost siding panel is being mounted.

FIG. 5 is a fragmentary, perspective view of the supporting member and the retaining member, in an alternative embodiment omitting structure shown in full lines in FIGS. 1, 2, and 3 and in broken lines in FIG. 4, before the retaining member is mounted to the supporting member.

FIG. 6 is a fragmentary, perspective view of another alternative embodiment of the siding panel-trimming and soffit-panel mounting assembly.

DETAILED DESCRIPTION OF THE ILLUSTRATED EMBODIMENTS

Figure 1:
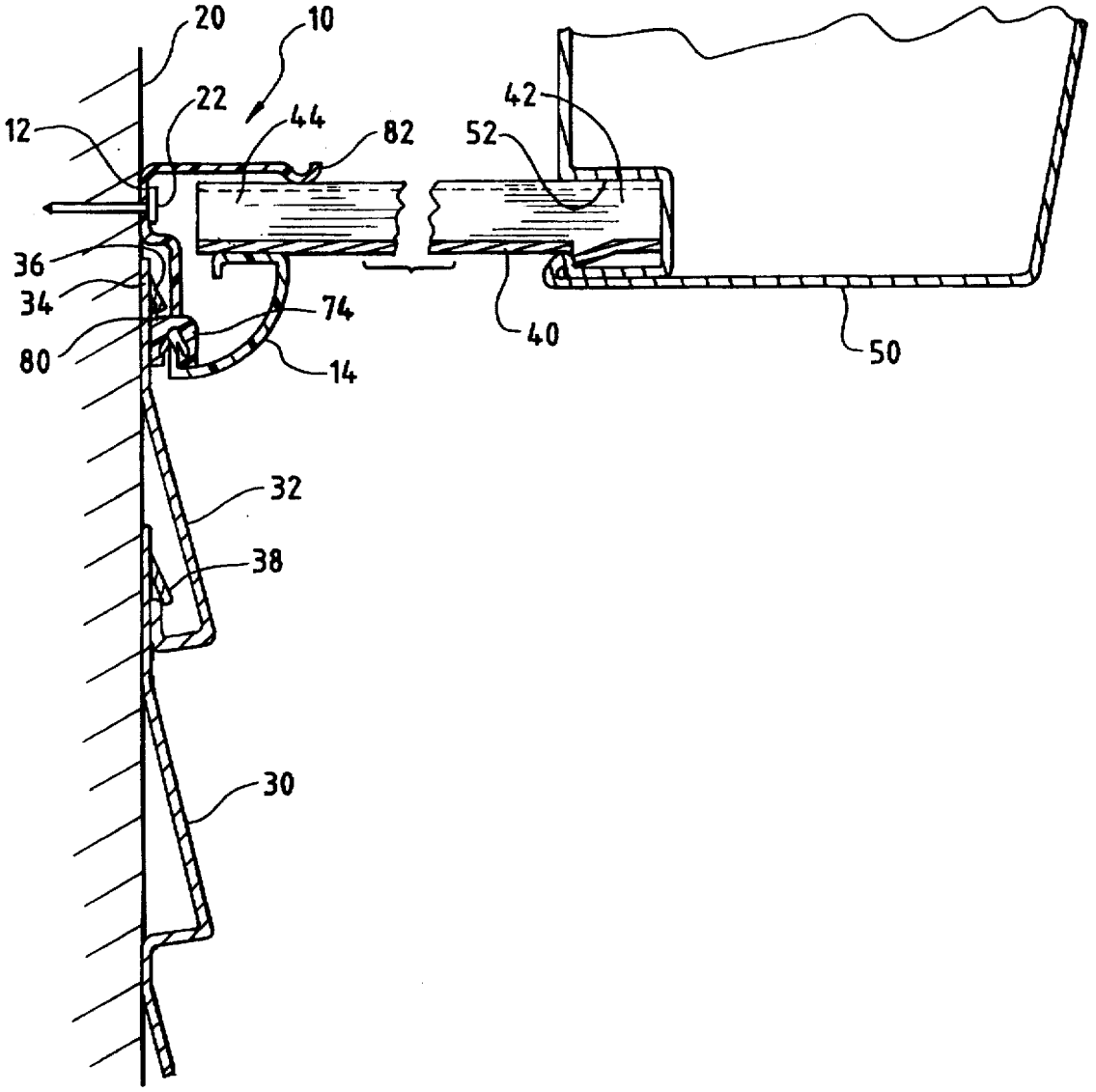
FIG. 1 is a fragmentary, sectional view taken along a vertical plane and showing a building wall, a gutter, a soffit panel, siding panels, and a siding panel-trimming and soffit-panel mounting assembly comprising a supporting member and a retaining member and according to a preferred embodiment of the present invention.

As shown in FIGS. 1, 2, 3, and 4, a siding panel-trimming and soffit panel-mounting assembly 10 constitutes a preferred embodiment of this invention. The assembly 10 comprises a supporting member 12 and a retaining member 14. Preferably, the supporting member 12 and the retaining member 14 are separate members extruded from a polymeric material, such as polyvinyl chloride. The supporting member 12 and the retaining member 14 may be alternatively extruded from aluminum.

The supporting member 12 is mounted to a building wall 20, via nails 22, and may be suitably marked, indented, or punched with holes where the nails 22 may be optimally driven. The assembly 10 comprising the supporting member 12 and the retaining member 14 is useful with generally vertical siding panels 30, which include an uppermost siding panel 32, a generally horizontal soffit panel 40, and a gutter-facade structure 50. The assembly 10 is used in mounting the uppermost siding member 32 without any need for a separate element, such as an undersill trim, and in mounting the soffit panel 40 without any need for a separate element, such as a wooden nailing strip. Preferably, the siding panels 30, the soffit panel 40, and the gutter-facade structure 50 are roll-formed from aluminum coil stock, which has been pre-painted.

The uppermost panel 32 is punched along an upper edge portion 34, in a known manner, so as to have laterally spaced trim-engaging tabs 36. A punching tool suitable for punching the uppermost siding panel 32 is available commercially from Omni Products (a division of ZMC, Inc.) of Addison, Ill., under Product Code No. VS9700. The other siding panels 30 may be similarly punched so as to have similar tabs 38, by which the other siding panels 30 are interconnected with each other, and by which the siding panel 30 below the uppermost siding panel 32 is interconnected with the uppermost siding panel 32. Usage of such tabs to interconnect siding panels with each other has been known heretofore.

The soffit panel 40 has a front edge portion 42 and a back edge portion 44. The gutter-facade structure 50 is formed with a channel 52, into which the front edge portion of the soffit panel 40 is inserted. Preferably, the soffit panel 40 and the gutter-facade structure 50 are interconnected, where the front edge portion 42 of the soffit panel 40 is inserted into the channel 52, in a manner disclosed in International Application No. PCT/US95/04922, as published as International Publication No. WO 95/30809, the disclosure of which is incorporated herein by reference. Alternatively, the soffit panel 40 and the gutter-facade structure 50 are associated, where the front edge portion 42 of the soffit panel 40 is inserted into the channel 52, in a manner disclosed in U.S. Pat. No. 4,092,808.

As extruded, the supporting member 12 has a back panel 60, which is stepped so as to define a generally vertical upper portion 62, a generally horizontal middle portion 64, and a generally vertical lower portion 66. Being behind and above the lower portion 66, the upper portion 62 is joined to the lower portion 64 by the middle portion 66. Moreover, the supporting member 12 has an upper front flange 70 projecting frontwardly from an upper edge 72 of the upper portion 62 of the back panel 60. Furthermore, the supporting member 12 has an elongate receptacle 74 extending along a lower edge 76 of the lower portion 66 of the back panel 60. The elongate receptacle 74 defines an elongate socket 78, which is arrowhead-profiled when viewed in cross-section, and an elongate hook 80, which extends along the supporting member 12, behind the lower portion 66 of the back panel 60. The upper front flange 70 is spoon-profiled at its distal end 82.

As extruded, the retaining member 14 has a lower front flange 90 extending along the retaining member 14. The lower front flange 90 has a curved portion 92, which curves frontwardly and upwardly, and a flat portion 94, which projects backwardly from an upper edge 96 of the curved portion 92, and which has a downturned edge 96. Moreover, the retaining member 14 has a back flange 100, which projects upwardly from a back edge 102 of the curved portion 92 of the lower front flange 90. An upper portion 104 of the back flange 100 is arrowhead-profiled when viewed in cross-section, so as to conform to the elongate socket 78. The upper portion 104 of the back flange 100 and the elongate socket 78 are shaped complementarily so as to enable the upper portion 104 of the back flange 100 to be snap-fitted into the elongate socket 78.

After the supporting member 12 has been mounted to the building wall 20, via nails 22, the front edge portion 42 of the soffit panel 40 is interconnected with the gutter-facade structure 50, in the manner disclosed in International Publication No. WO 95/90809, supra. Thereupon, until the retaining member 14 is mounted to the supporting member 12, the soffit panel 40 is held manually so that the upper front flange 70 defined by the supporting member 12 overlies the back edge portion 44 of the soffit panel 40.

Figure 2:
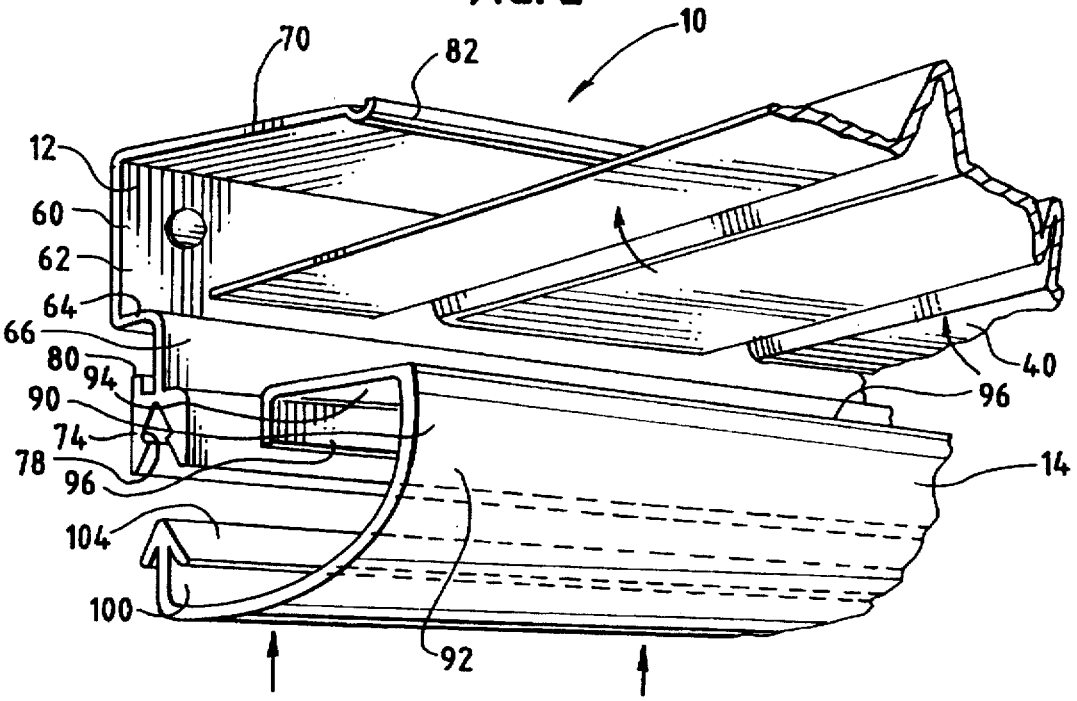
FIG. 2 is a fragmentary, perspective view of the supporting and retaining members as the retaining member is being mounted to the supporting member so as to mount a back edge portion of the soffit panel, which also is shown fragmentarily.
Figure 3:
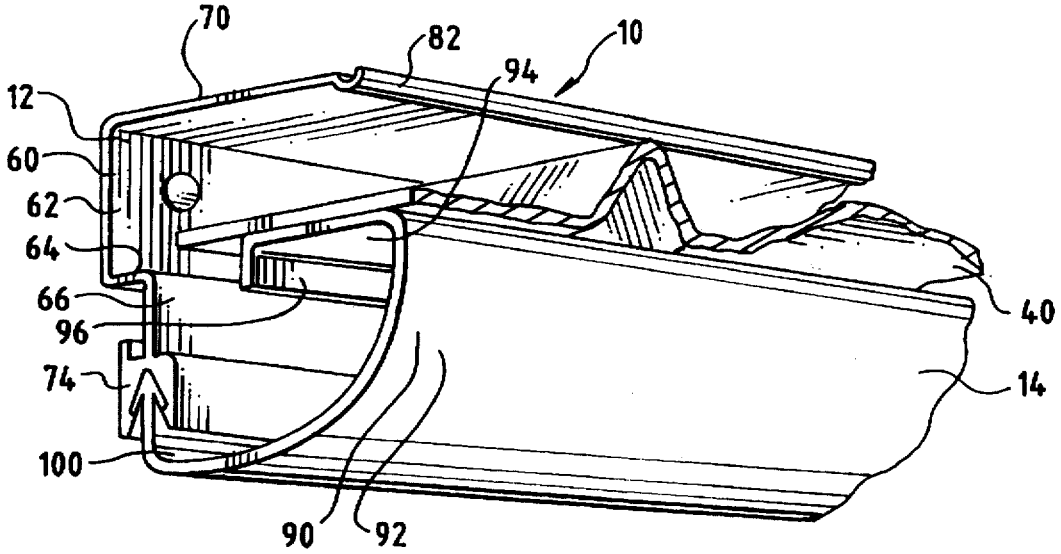
FIG. 3 is a fragmentary, perspective view of the supporting and retaining members after the retaining member has been mounted to the supporting member so as to mount the back edge portion of the soffit panel, which also is shown fragmentarily.

As shown in FIGS. 2 and 3, when the retaining member 14 is mounted to the supporting member 12, the arrowhead-profiled, upper portion 104 of the back flange 100 is snap-fitted into the arrowhead-profiled, elongate socket 78 of the elongate receptacle 74, so that the lower front flange 90 defined by the retaining member 14 underlies the front edge portion 44 of the soffit panel 40. Thus, after the retaining member 14 has been mounted to the supporting member 12, the front edge portion of the soffit panel 40 is retained between the upper front flange 70 and the lower front flange 90. The flat portion 94 of the lower front flange 90 supports the front edge portion 42 of the soffit panel 40, as shown in FIG. 1, and limits flexure of the lower front flange 90 toward the back panel 60.

As shown in FIG. 4, either before or after the retaining member 14 has been mounted to the supporting member 12, the upper edge portion 34 of the uppermost siding panel 32 is pushed upwardly behind the lower portion 66 of the back panel 60 of the supporting member 12, until the trim-engaging tabs 36 interengage with the elongate hook 80 on the elongate receptacle 74. The back panel 60 has sufficient flexibility and sufficient resiliency to flex so as to permit such tabs 36 to move upwardly past the elongate hook 80 when the upper edge portion 34 is pushed upwardly. Such tabs 36, other portions of the uppermost siding panel 32, and one or more of the siding panels 30 below the uppermost siding panel 32 may flex, if and as necessary to permit the upper edge portion 34 to be upwardly pushed behind the lower portion 66 of the back panel 60 of the supporting member 12.

The alternative embodiment of FIG. 5 is similar to the preferred embodiment, except that the flat portion 94 of the lower front flange 90 defined by the retaining member 14 is omitted, its omission being suggested by broken lines, and except that the upper edge 96 of the curved portion 92 has a bead-shaped profile.

In the alternative embodiment of FIG. 6, the flat portion 94 of the lower front flange 90 defined by the retaining member 14 is omitted, and the upper edge 96 of the curved portion 92 has a bead-shaped profile. Moreover, the elongate receptacle 74 of the preferred embodiment is omitted. Rather, an upturned hook 110 is formed along the lower edge 76 of the lower portion 66 of the back panel 60 of the supporting member 12. Furthermore, the arrowhead-profiled, upper portion 104 of the back flange 100 of the retaining member 14 is omitted. Rather, the back flange 100 is shaped so as to define a downturned hook 120 and an upturned hook 130, which is above and behind the downturned hook 120. Both hooks 120, 130, extend along the back flange 100.

In the alternative embodiment of FIG. 6, the downturned hook 120 of the retaining member 14 is interengaged with the upturned hook 110 of the supporting member 12, as shown, when the retaining member 14 is mounted to the supporting member 12. Moreover, the upturned hook 130 of the retaining member 14 functions as the elongate hook 80 of the preferred embodiment functions and interengages with the trim-engaging tabs 36 (not shown in FIG. 6) on the upper edge portion 34 of the uppermost siding panel 32.

Various modifications may be made in any of the aforenoted embodiments without departing from the scope and spirit of this invention.

We claim:

1. A combination comprising a generally horizontal soffit panel having a back edge portion, a generally vertical siding panel having an upper edge portion formed with at least two laterally spaced trim-engaging tabs, and a siding panel-trimming and soffit-panel mounting assembly comprising a supporting member and a retaining member, the supporting member having a generally vertical back panel and an upper front flange, the upper front flange projecting frontwardly from the back panel and overlying the back edge portion of the soffit panel, the retaining member being a separate member attached to the supporting member and having a lower front flange, the lower front flange projecting from the back panel and underlying the back edge portion of the soffit panel, one of the supporting and retaining members defining a hook behind the back panel, the hook interengaging with the trim-engaging tabs on the upper edge portion of the siding panel, for trimming and mounting the upper edge portion of the siding panel so as to conceal the upper edge portion of the siding panel and said tabs behind the back panel.

2. The combination of claim 1 wherein the retaining member has a back flange and wherein the supporting member has means for receiving the back flange of the retaining member so as to attach the retaining member to the supporting member and so as to conceal the back flange of the retaining member behind the back wall.

3. The combination of claim 2 wherein the back panel is stepped so as to have an upper portion, a middle portion, and a lower portion including the receiving means, the upper portion being behind and above the lower portion, the upper and lower portions being generally vertical.

4. The combination of claim 3 wherein the receiving means defines the hook interengaging with the trim-engaging tabs on the upper edge portion of the siding member.

5. The combination of claim 4 wherein the receiving means defines a downwardly opening socket and wherein an upper portion of the back flange of the retaining member projects upwardly into the downwardly opening socket.

6. The combination of claim 5 wherein the downwardly opening socket and the upper portion of the back flange of the retaining member are shaped complementarily so as to enable the back edge portion of the retaining to be snap-fitted into the downwardly opening socket.

7. The combination of claim 3 wherein the retaining member defines the hook interengaging with the trim-engaging tabs on the upper edge portion of the siding member.

8. The combination of claim 7 wherein the lower portion of the back panel defines an upturned hook and wherein the back flange of the retaining member defines a downturned hook interengaging with the upturned hook.

9. The combination of any one of the preceding claims wherein each of the supporting and retaining members is extruded in one piece.

10. The combination of claim 9 wherein each of the supporting and retaining members is extruded from a polymeric material.

* * * * *

UNITED STATES PATENT AND TRADEMARK OFFICE

CERTIFICATE OF CORRECTION

PATENT NO. : 5,711,117

DATED : January 27, 1998

INVENTOR(S) : Richard J. Zaccagni and Gregory R. Zaccagni

It is certified that error appears in the above-indentified patent and that said Letters Patent is hereby corrected as shown below:

Column 2, line 38, "lowe" should be --lower--.

Column 2, line 43, second occurrence of "of" should be deleted.

Column 4, line 20, "64" should be --66--.

Column 4, line 20, "66" should be --64--.

Column 4, lines 36, "96" should be --94--.

Col. 6, line 4, claim 6, after "retaining", --member-- should be inserted.

Signed and Sealed this

Sixteenth Day of June, 1998

*Attest:*

*Attesting Officer*

Bruce Lehman

BRUCE LEHMAN

*Commissioner of Patents and Trademarks*